US007143595B2

(12) United States Patent
Doi et al.

(10) Patent No.: US 7,143,595 B2
(45) Date of Patent: Dec. 5, 2006

(54) SUPERCRITICAL REFRIGERANT CYCLE SYSTEM

(75) Inventors: Shigetoshi Doi, Gunma (JP); Toshiyuki Ebara, Gunma (JP); Yoshiaki Kurosawa, Saitama (JP); Mitsuhiko Ishino, Saitama (JP); Eiji Fukuda, Gunma (JP); Yoshihiko Kobayashi, Gunma (JP); Aritomo Yoshida, Gunma (JP)

(73) Assignee: Sanyo Electric Co., Ltd., Osaka (JP)

( * ) Notice: Subject to any disclaimer, the term of this patent is extended or adjusted under 35 U.S.C. 154(b) by 0 days.

(21) Appl. No.: 11/029,392

(22) Filed: Jan. 6, 2005

(65) Prior Publication Data

US 2005/0150240 A1 Jul. 14, 2005

Related U.S. Application Data

(62) Division of application No. 10/453,936, filed on Jun. 4, 2003, now abandoned.

(30) Foreign Application Priority Data

Jun. 4, 2002 (JP) ..... 2002-163293
Jun. 4, 2002 (JP) ..... 2002-163296

(51) Int. Cl.
*F25B 49/02* (2006.01)

(52) U.S. Cl. ..... 62/228.4; 62/228.5

(58) Field of Classification Search ..... 62/228.4, 62/228, 5, 244, 225
See application file for complete search history.

(56) References Cited

U.S. PATENT DOCUMENTS 2,260,682 A 10/1941 Robson
4,603,556 A * 8/1986 Suefuji et al. ..... 62/180
5,099,654 A * 3/1992 Baruschke et al. ..... 62/180
5,507,155 A * 4/1996 Negishi ..... 62/228.4
5,877,476 A 3/1999 Yabuki et al.
6,012,299 A 1/2000 Schmidt et al.
6,134,900 A 10/2000 Nishida et al.
6,164,081 A 12/2000 Jensen et al.
6,341,496 B1 1/2002 Kettner et al.

(Continued)

FOREIGN PATENT DOCUMENTS

EP 0 837 291 A2 4/1998

(Continued)

OTHER PUBLICATIONS

1995 International CFC and Halon Alternatives Conference & Exhibition: Stratospheric Ozone Protection for the 90's, Conference Proceedings; Oct. 23-25, 1995; The Alliance for Responsible Atmospheric Policy; Washington, D.C.

*Primary Examiner*—William E. Tapolcai
(74) *Attorney, Agent, or Firm*—McDermott Will & Emery LLP

(57) ABSTRACT

An object of the present invention is to improve a heat exchanging capability in an evaporator in a refrigerant cycle system in which a high pressure side is operated at a supercritical pressure. The refrigerant cycle system is a refrigerant cycle system in which a compressor, a gas cooler, an expansion valve and an evaporator are sequentially connected in a cyclic form and a high pressure side is operated at a supercritical pressure, wherein the degree of opening of the expansion valve is adjusted based on the temperature and pressure of a refrigerant at an outlet of the evaporator so as to control the degree of superheat at the outlet of the evaporator. An abstract of the present invention is to make large the degree of superheat at the outlet of the evaporator by means of the expansion valve.

6 Claims, 5 Drawing Sheets

U.S. PATENT DOCUMENTS

| | | | | |
|---|---|---|---|---|
| 6,381,971 | B1 * | 5/2002 | Honda | 62/126 |
| 6,430,950 | B1 * | 8/2002 | Dienhart et al. | 62/222 |
| 6,494,051 | B1 | 12/2002 | Sakakibara et al. | |
| 6,786,057 | B1 * | 9/2004 | Ben Yahia | 62/222 |

FOREIGN PATENT DOCUMENTS

| | | |
|---|---|---|
| EP | 1 026 459 A1 | 8/2000 |
| EP | 1 209 357 A1 | 5/2002 |
| JP | 2000-249411 | 9/2000 |
| JP | 2001-108314 | 4/2001 |
| JP | 2001-147048 | 5/2001 |
| JP | 2002-156146 | 5/2002 |
| JP | 2002-156163 | 5/2002 |

* cited by examiner

SUPERCRITICAL REFRIGERANT CYCLE SYSTEM

CROSS-REFERENCE TO RELATED APPLICATIONS

This application is a divisional of application Ser. No. 10/453,936 filed on Jun. 4, 2003, now abandoned.

BACKGROUND OF THE INVENTION (i) Field of the Invention

The present invention relates to a refrigerant cycle system in which a compressor, a gas cooler, throttle means and an evaporator are sequentially connected-in a cyclic form and a high pressure side is operated at a supercritical pressure.

(ii) Description of the Related Art

Heretofore, in an automotive air conditioner for air-conditioning the inside of an automobile, for example, a rotary compressor (compressor), a gas cooler, an intermediate heat exchanger, throttle means (such as an expansion valve), an evaporator and the like are sequentially connected in a cyclic form via pipes so as to constitute a refrigerant cycle (refrigerant circuit). A refrigerant gas is sucked into a low pressure chamber of a cylinder from a suction port of a rotary compression element of the rotary compressor and then compressed by the actions of a roller and a vane so as to become a high temperature/high pressure refrigerant gas. Then, the refrigerant gas goes out of a high pressure chamber, passes through a discharge port and a discharge silencing chamber, and flows into the gas cooler so as to dissipate heat. After the refrigerant gas exchanges heat with a refrigerant of lower pressure in the intermediate heat exchanger, it is reduced by the throttle means and fed to the evaporator. The refrigerant evaporates therein, and during the evaporation, it exhibits a cooling effect by absorbing heat from its surroundings so as to air-condition the inside of the automobile.

Meanwhile, in recent years, in consideration of global environmental issues, it has been attempted that $CO_2$ (carbon dioxide) which is a natural refrigerant as described in, for example, Japanese Patent Publication No. 18602/1995 is used as a refrigerant in place of conventionally used fron and a high pressure side is operated as a supercritical pressure even in a refrigerant cycle such as the automotive air conditioner of the above type. However, since it has conventionally been assumed that a receiver tank is provided subsequently to the evaporator so as to reserve a liquid refrigerant therein, the degree of superheat of a refrigerant at the outlet of the evaporator is not adjusted.

That is, since the throttle means (expansion valve) is rather opened, the evaporating temperature of the refrigerant in the evaporator becomes high, so that it cannot exchange heat with air to a sufficient extent. As a result, there arise problems that the required amount of circulating refrigerant must be increased so as to obtain a desired cooling capacity (refrigerating capacity) and power consumption in the compressor increases.

Further, heretofore, the amount of liquid refrigerant in the receiver tank has been adjusted to control the cooling capacity (refrigerating capacity). That is, since the degree of opening of the throttle means (expansion valve) is adjusted by the amount of the liquid refrigerant reserved in the receiver tank, a refrigerant in the evaporator shifts from a state of a mixture of two phases, i.e., gas and a liquid, to a gaseous state nearly completely when, for example, the throttle means is rather closed under a high heat load. Hence, a refrigerant of lower pressure which has flown into the intermediate heat exchanger cannot cool a refrigerant of high pressure sufficiently. As a result, the temperature of a refrigerant at the inlet of the throttle means becomes high, whereby the cooling capacity deteriorates. For this reason as well, the required amount of circulating refrigerant must be increased so as to obtain a desired cooling capacity, and power consumption in the compressor increases.

Thus, when the cooling capacity is controlled by adjusting the amount of the liquid refrigerant in the receiver tank, it is difficult to constantly keep the refrigerating capacity of the evaporator in an optimum condition, so that there arises a problem that the cooling capacity in the evaporator deteriorates.

SUMMARY OF THE INVENTION

The present invention has been conceived to solve the technical problems of the prior art. An object of the present invention is to improve a heat exchanging capability in an evaporator in a refrigerant cycle system in which a high pressure side is operated at a supercritical pressure.

That is, in the present invention, the degree of opening of throttle means is adjusted based on the temperature and pressure of a refrigerant at the outlet of the evaporator of the refrigerant cycle system so as to control the degree of superheat at the outlet of the evaporator. Thus, when the degree of superheat at the outlet of the evaporator is rendered large by, for example, the throttle means, a difference in enthalpy of the refrigerant in the evaporator becomes large, so that an optimum heat exchanging capability in the evaporator can be attained.

Thereby, a desired refrigerating capacity can be maintained while the external dimension of the evaporator and the amount of circulating refrigerant are reduced, and power consumption in a compressor can also be reduced.

Further, in the present invention, the degree of opening of the throttle means is adjusted based on heat load conditions so as to control the degree of superheat at the outlet of the evaporator. Thus, for example, when the degree of superheat at the outlet of the evaporator is decreased when a heat load is high and increased when the heat load is low, a difference in enthalpy in the refrigerant in the evaporator becomes large, and an optimum cooling capacity in the evaporator can be attained.

Thereby, the refrigerating capacity of the evaporator can be retained in an optimum condition all the time even if heat load conditions are changed.

Particularly, since it becomes possible to enhance the refrigerating capacity without increasing the amount of circulating refrigerant under a high heat load, an improvement in the coefficient of performance of the compressor can be achieved.

Further, the system of the present invention further comprises an intermediate heat exchanger for-allowing a refrigerant coming out of a gas cooler to exchange heat with a refrigerant coming out of the evaporator and a receiver tank for temporarily reserving a refrigerant to be sucked into the compressor and causes a refrigerant coming out of the evaporator and passing through the intermediate heat exchanger to flow into the receiver tank. As a result, a low temperature refrigerant coming out of the evaporator is allowed to flow into the intermediate heat exchanger without passing through the receiver tank so as to cool a refrigerant coming out of the gas cooler more effectively. Thereby, a further improvement in the refrigerating capacity (cooling capacity) of the evaporator can be achieved.

Further, in the present invention, in addition to the above inventions, a $CO_2$ refrigerant is used. This can contribute to the elimination of environmental issues.

DETAILED DESCRIPTION OF THE PREFERRED EMBODIMENTS

Figure 1:
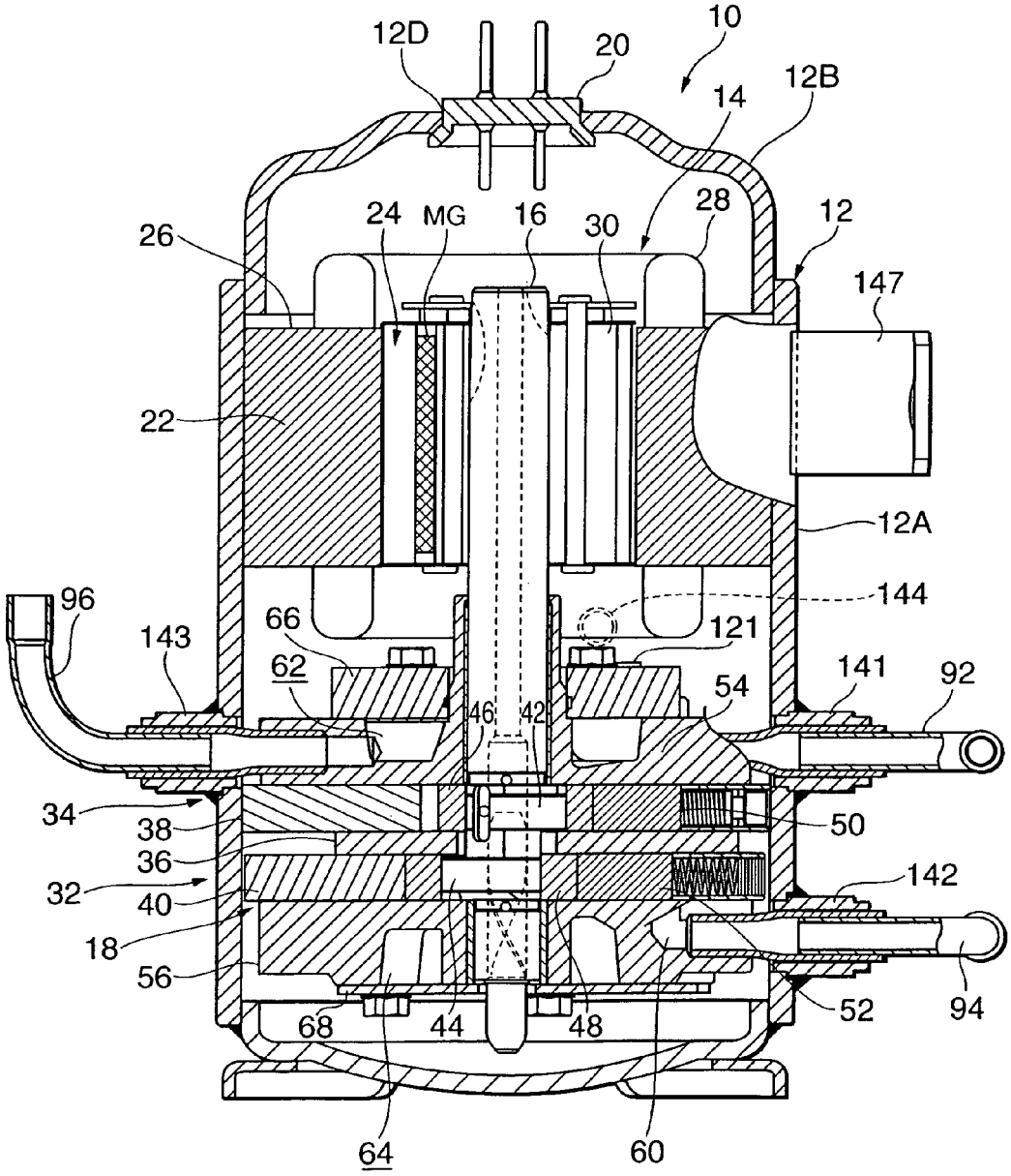
FIG. 1 is a longitudinal section of a multistage compression rotary compressor which constitutes a refrigerant cycle of the present invention.

Next, an embodiment of the present invention will be described in detail with reference to the drawings. FIG. 1 is a longitudinal section of an internal intermediate pressure type multistage (two stage) compression rotary compressor 10 having first and second rotary compression elements as an embodiment of a compressor used in a refrigerant cycle system of the present invention.

That is, reference numeral 10 denotes an internal intermediate pressure type multistage compression rotary compressor using $CO_2$ (carbon dioxide) as a refrigerant. The compressor 10 comprises a sealed cylindrical vessel 12 which is formed of a steel plate, an electrically driven element 14 which is placed in an upper portion of the inside of the sealed vessel 12, and a rotary compression mechanism 18 comprising a first rotary compression element 32 (first stage) and a second rotary compression element 34 (second stage) which are placed under the electrically driven element 14 and driven by a rotation shaft 16 of the electrically driven element 14.

The sealed vessel 12 holds oil at the bottom. The sealed vessel 12 comprises a vessel body 12A which accommodates the electrically driven element 14 and the rotary compression mechanism 18 and a nearly bowl shaped end cap 12B for closing an opening at the top of the vessel body 12A. Further, the end cap 12B has a circular mounting hole 12D formed at the center of its top surface, and a terminal (wiring omitted) 20 for supplying power to the electrically driven element 14 is installed in the mounting hole 12D.

The electrically driven element 14 comprises a ring-shaped stator 22 which is installed along the internal surface of the upper portion of the sealed vessel 12 and a rotor 24 which is placed inside the stator 22 with a small spacing therebetween. The rotor 24 is secured to the rotation shaft 16 which passes through the center and extends in a vertical direction.

The stator 22 has a laminate 26 of doughnut-shaped electromagnetic steel plates and a stator coil 28 which is formed by direct winding (concentrated winding) on the tooth of the laminate 26. Further, the rotor 24 is formed by a laminate 30 of electromagnetic steel plates as in the case of the stator 22 and has a permanent magnet MG inserted in the laminate 30.

An intermediate partition plate 36 is held between the above first rotary compression element 32 and the above second rotary compression element 34. That is, the first rotary compression element 32 and the second rotary compression element 34 comprise the intermediate partition plate 36, upper and lower cylinders 38 and 40 which are placed on the upper and lower surfaces of the intermediate partition plate 36, upper and lower rollers 46 and 48 which eccentrically rotate in upper and lower eccentric portions 42 and 44 provided on the rotation shaft 16 at a phase difference of 180° in the upper and lower cylinders 38 and 40, vanes 50 and 52 which are in contact with the upper and lower rollers 46 and 48 so as to section the inner portions of the upper and lower cylinders 38 and 40 into low pressure chambers and high pressure chambers, and upper and lower supporting members 54 and 56 as supporting members which close the upper opened surface of the upper cylinder 38 and the lower opened surface of the lower cylinder 40 and also serve as bearings for the rotation shaft 16.

Meanwhile, the upper and lower supporting members 54 and 56 have suction passages 60 (suction passage in the upper supporting member is not shown) which communicate with the internal portions of the upper and lower cylinders 38 and 40 at suction ports which are not shown and discharge silencing chambers 62 and 64 which are formed by making dents in the supporting members and covering the dents with upper and lower covers 66 and 68.

The discharge silencing chamber 64 communicates with the inside of the sealed vessel 12 via a communicating passage penetrating the upper and lower cylinders 38 and 40 and the intermediate partition plate 36. At the upper end of the communicating passage, an intermediate discharge pipe 121 is disposed. A refrigerant of intermediate pressure compressed by the first rotary compression element 32 is discharged from the intermediate discharge pipe 121 into the sealed vessel 12.

Further, the upper cover 66 which closes the opening at the top of the discharge silencing chamber 62 which communicates with the internal portion of the upper cylinder 38 of the second rotary compression element 34 partitions the internal portion of the sealed vessel 12 into the discharge silencing chamber 62 and the electrically driven element 14.

As the refrigerant, the foregoing $CO_2$ (carbon dioxide) which is a naturally occurring refrigerant is used in consideration of ecology-friendliness, inflammability and toxicity. As oil as a lubricating oil, an existing oil such as a mineral oil, an alkylbenzene oil, an ether oil, an ester oil or PAG (polyalkyl glycol) is used.

On the side of the vessel body 12A of the sealed vessel 12, sleeves 141, 142, 143 and 144 are secured by welding at positions corresponding to the suction passages 60 (upper suction passage is not shown) of the upper and lower supporting members 54 and 56, the discharge silencing chamber 62, and a portion above the upper cover 66 (or portion corresponding to nearly the lower end of the electrically driven element 14). Further, one end of a refrigerant feeding pipe 92 for feeding a refrigerant gas to the upper cylinder 38 is inserted into and connected to the sleeve 141. This end of the refrigerant feeding pipe 92 communicates with the suction passage in the upper cylinder 38 which is not shown. The other end of the refrigerant feeding pipe 92 passes over the sealed vessel 12, reaches the sleeve 144 and is inserted into and connected to the sleeve 144 so as to communicate with the internal portion of the sealed vessel 12.

Further, one end of a refrigerant feeding pipe 94 for feeding a refrigerant gas to the lower cylinder 40 is inserted into and connected to the sleeve 142. This end of the refrigerant feeding pipe 94 communicates with the suction passage 60 in the lower cylinder 40. The other end of the refrigerant feeding pipe 94 is connected to the lower portion of a receiver tank 158 to be described later. In addition, a refrigerant discharge pipe 96 is inserted into and connected to the sleeve 143, and one end of the refrigerant feeding pipe 96 communicates with the discharge silencing chamber 62.

The receiver tank 158 is a tank which subjects a refrigerant sucked into the compressor 10 to gas-liquid separation and is attached to a bracket 147 welded to the side of the upper portion of the vessel body 12A of the sealed vessel 12.

Figure 2:
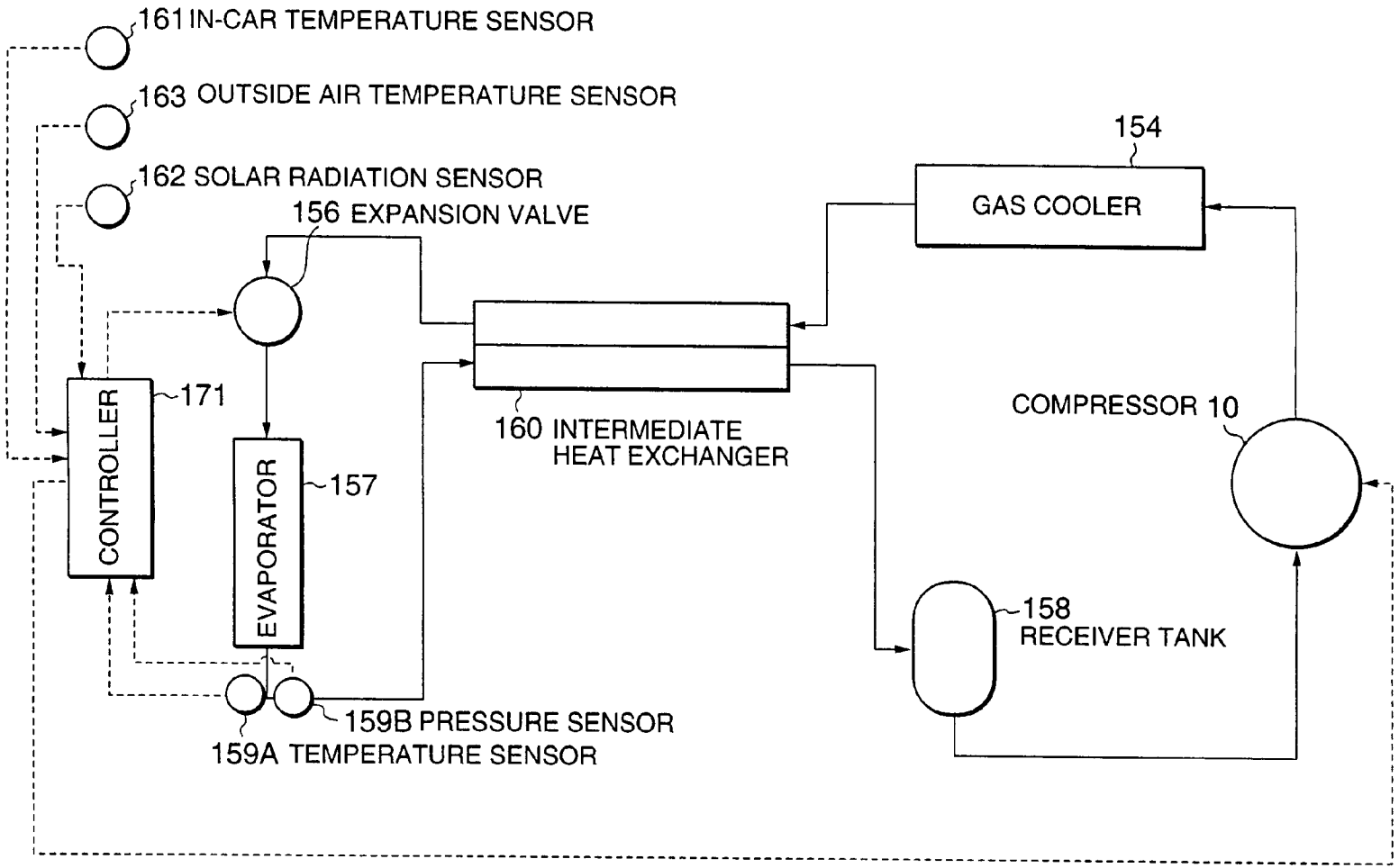
FIG. 2 is a diagram showing a refrigerant cycle of an air conditioner for an automobile which is an embodiment of the present invention.

FIG. 2 shows a refrigerant cycle when the present invention is applied to an automotive air conditioner for cooling the inside of an automobile. The foregoing compressor 10 constitutes a portion of the refrigerant cycle of the automotive air conditioner shown in FIG. 2. More specifically, the refrigerant discharge pipe 96 of the compressor 10 is connected to the inlet of a gas cooler 154. A pipe extending from the gas cooler 154 reaches an electronic expansion valve 156 which serves as throttle means via an intermediate heat exchanger 160.

The outlet of the expansion valve 156 is connected to the inlet of an evaporator 157, and the outlet of the evaporator 157 reaches the above receiver tank 158 via the intermediate heat exchanger 160. The outlet of the receiver tank 158 is connected to the refrigerant feeding pipe 94. Reference numeral 171 denotes a controller for controlling (adjusting) the number of revolutions of the electrically driven element 14 of the above compressor 10 and the degree of opening of the expansion valve 156. To the controller 171, the output of a temperature sensor 159A for sensing the temperature of a refrigerant at the outlet of the evaporator 157, the output of a pressure sensor 159B for sensing the pressure of the refrigerant at the outlet of the evaporator 157, the output of an in-car temperature sensor 161 for sensing the temperature of the inside of an automobile which is not shown, the output of a solar radiation sensor 162 for sensing the amount of solar radiation entering the inside of the automobile and the output of an outside air temperature sensor 163 for sensing the temperature of outside air are also input.

Next, the operations of the above constitution will be described with reference to the p-h diagram (Mollier chart) of FIG. 3. Upon energization of the stator coil 28 of the electrically driven element 14 of the compressor 10 by the controller 171 via the terminal 20 and wiring which is not shown, the electrically driven element 14 is activated and the rotor 24 starts to spin. This spinning causes the upper and lower rollers 46 and 48 that are fit in the upper and lower eccentric portions 42 and 44 that are integrally formed with the rotation shaft 16 to eccentrically rotate within the upper and lower cylinders 38 and 40.

Thereby, a low pressure refrigerant (state A indicated by the solid line in FIG. 3) sucked into the low pressure chamber of the cylinder 40 from a suction port which is not shown via the refrigerant feeding pipe 94 and the suction passage 60 formed in the lower supporting member 56 is compressed to an intermediate pressure by the actions of the roller 48 and the vane 52 and then discharged into the sealed vessel 12 from the high pressure chamber of the lower cylinder 40 via a communicating passage which is not shown and the intermediate discharge pipe 121. As a result, the inside of the sealed vessel 12 becomes an intermediate pressure.

Then, the intermediate pressure refrigerant gas in the sealed vessel 12 goes out from the sleeve 144, passes through the refrigerant feeding pipe 92 and the suction passage which is formed in the upper supporting member 54 and not shown, and then sucked into the low pressure chamber of the upper cylinder 38 from a suction port which is not shown. The intermediate pressure refrigerant gas sucked in is subjected to second compression by the actions of the roller 46 and the vane 50, thereby becoming a high pressure/high temperature refrigerant gas. Then, the refrigerant gas goes out of the high pressure chamber, passes through a discharge port which is not shown and is then discharged from the refrigerant discharge pipe 96 to the outside via the discharge silencing chamber 62 formed in the upper supporting member 54. At this point, the refrigerant has been compressed to a supercritical pressure (state B indicated by the solid line in FIG. 3).

The refrigerant gas discharged from the refrigerant discharge pipe 96 flows into the gas cooler 154 to be cooled by air or water and then passes through the intermediate heat exchanger 160. The refrigerant is then further cooled by a refrigerant of lower pressure in the exchanger 160 (state C in FIG. 3) and then reaches the expansion valve 156.

Figure 3:
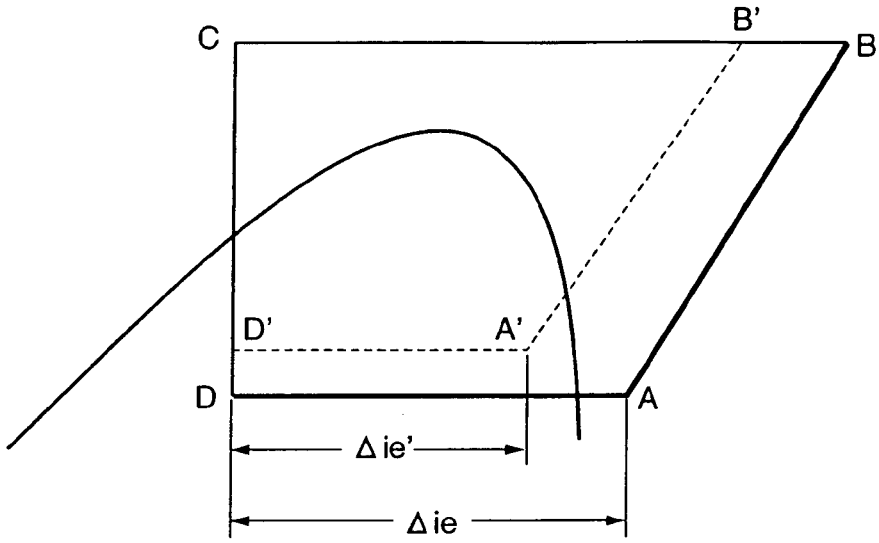
FIG. 3 is a p-h diagram of the refrigerant cycle of FIG. 2.

The refrigerant becomes a mixture of two phases, i.e., gas and a liquid, as shown by D indicated by the solid line in FIG. 3, due to a reduction in pressure at the expansion valve 156 and flows into the evaporator 157 in that state. The refrigerant evaporates therein and absorbs heat from air circulating inside the automobile. Thus, the refrigerant exhibits a cooling effect so as to cool the inside of the automobile. Thereafter, the refrigerant flows out of the evaporator 157 (state A in FIG. 3). Then, the refrigerant passes through the intermediate heat exchanger 160 so as to be heated by a refrigerant of higher pressure and then reaches the receiver tank 158. In the receiver tank 158, the refrigerant undergoes gas-liquid separation, and only a gas refrigerant is sucked into the first rotary compression element 32 of the compressor 10 from the refrigerant feeding pipe 94. The above cycle is repeated.

The controller 171 controls the number of revolutions of the electrically driven element 14 of the compressor 10 based on the outputs of the in-car temperature sensor 161, the solar radiation sensor 162 and the outside air temperature sensor 163 so as to adjust the cooling capacity (refrigerating capacity) of the refrigerant cycle, thereby keeping the temperature of the inside of the automobile at a set temperature.

Further, the controller 171 controls the degree of opening of the expansion valve 156 based on the temperature and pressure of the refrigerant at the outlet of the evaporator 157 which are detected by the temperature sensor 159A and the pressure sensor 159B. At that time, the controller 171 rather reduces the degree of opening of the valve so that the degree of superheat (state A indicated by the solid line in FIG. 3) at the outlet of the evaporator 157 becomes as large a value as about 5 deg.

When the degree of superheat of the evaporator 157 does not become such a large value as a result of rendering the expansion valve 156 rather opened as shown by A' indicated by the broken line in FIG. 3, the evaporating temperature of the refrigerant in the evaporator 157 becomes high, so that it cannot exchange heat with air to a sufficient extent, and the cooling capacity deteriorates.

This condition will be described with reference to FIG. 3. That is, when the degree of superheat does not take such a large value, a refrigerant discharged from the compressor 10 becomes a state B' indicated by the broken line in FIG. 3 and a refrigerant passing through the expansion valve 156 and flowing into the evaporator 157 becomes a state D' indicated by the broken line in FIG. 3. The cooling capacity Qe' of the refrigerant cycle in this case is expressed as $Qe'=\Delta ie'\times Gr'$ ($\Delta ie'$ is a difference in enthalpy between A' and D', and Gr' is the flow rate of refrigerant).

On the other hand, when the degree of superheat takes such a large value as described above, a cooling capacity Qe is expressed as $Qe=\Delta ie\times Gr$ ($\Delta ie$ is a difference in enthalpy between A and D, and Gr is the flow rate of refrigerant). It is understood from this drawing as well that because $\Delta ie$ indicated by the solid line becomes larger than $\Delta ie'$ indicated by the broken line, the cooling capacity Qe also becomes larger than Qe' when the degree of superheat does not take such a large value ($Qe>Qe'$).

Conversely, it is understood that to achieve a constant cooling capacity, the refrigerant flow rate Gr can be made smaller than Gr' ($Gr<Gr'$). Further, this indicates that the external diameter of the evaporator can be reduced.

Figure 4:
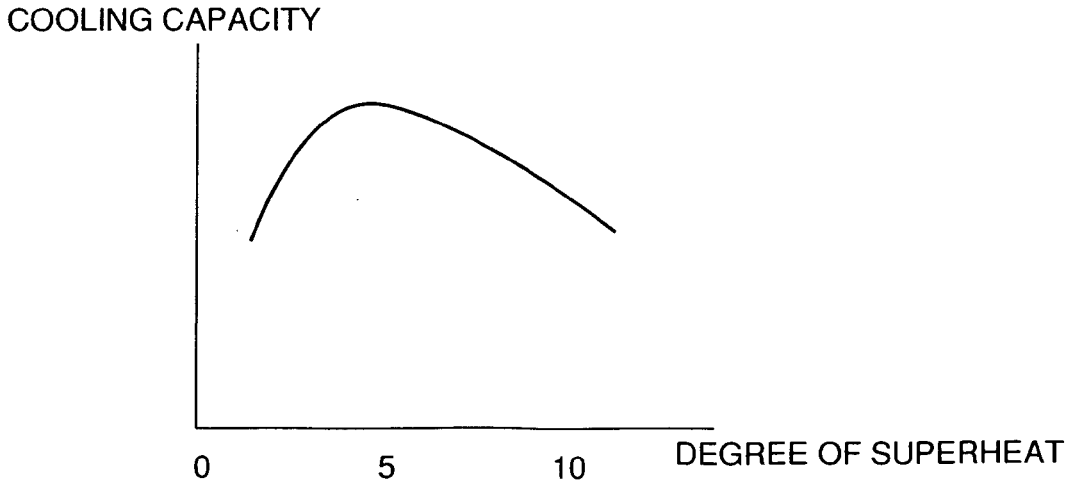
FIG. 4 is a diagram showing the relationship between the degree of superheat at the outlet of an evaporator and a cooling capacity.

Further, changes in the cooling capacity when the degree of superheat at the outlet of the evaporator 157 is changed by adjusting the degree of opening of the expansion valve 156 are shown in FIG. 4. It is clear from this drawing as well that the cooling capacity of the refrigerant cycle shows a peak around a degree of superheat of 5 deg.

An invariable capacity open compressor is driven by an engine via a belt. Therefore, the number of revolutions of the compressor depends on the number of revolutions of the engine, so that the amount of circulating refrigerant changes significantly according to a change in the speed of an automobile. Hence, it is difficult to keep the degree of superheat at the outlet of an evaporator at a predetermined value at all times, and a difference from the predetermined value is absorbed by the receiver tank. On the other hand, a variable capacity open compressor or an invariable capacity compressor driven by an electric motor undergo a small change in the amount of circulating refrigerant, so that it is easy to control the degree of superheat to a predetermined value. That is, the present invention can be more effective in a refrigerant system which undergoes a small change in the amount of circulating refrigerant.

As described in detail above, according to the present invention, in a refrigerant cycle system in which a compressor, a gas cooler, throttle means and an evaporator are sequentially connected in a cyclic form and a high pressure side is operated at a supercritical pressure, the degree of opening of the throttle means is adjusted based on the temperature and pressure of a refrigerant at the outlet of the evaporator so as to control the degree of superheat at the outlet of the evaporator. Thus, when the degree of superheat at the outlet of the evaporator is increased by the throttle means, a difference in enthalpy of the refrigerant in the evaporator becomes large, so that an optimum heat exchanging capability in the evaporator can be attained.

Thereby, a desired refrigerating capacity can be retained while the external dimension of the evaporator and the amount of circulating refrigerant are reduced, and power consumption in the compressor can also be reduced.

Further, the system further comprises an intermediate heat exchanger for allowing a refrigerant coming out of the gas cooler to exchange heat with a refrigerant coming out of the evaporator and a receiver tank for temporarily reserving a refrigerant to be sucked into the compressor and causes a refrigerant coming out of the evaporator and passing through the intermediate heat exchanger to flow into the receiver tank. As a result, a low temperature refrigerant coming out of the evaporator is allowed to flow into the intermediate heat exchanger without passing through the receiver tank so as to cool the refrigerant coming out of the gas cooler more effectively. Thereby, a further improvement in the refrigerating capacity can be made.

Further, in addition to the above inventions, a $CO_2$ refrigerant is used in the present invention. This can contribute to the elimination of environmental issues.

Next, another control of the degree of opening of the expansion valve 156 by the controller 171 will be described with reference to FIGS. 5 to 7. An overall constitution and basic temperature control in an automobile are the same as described above.

In this case as well, the controller 171 controls the degree of opening of the expansion valve 156 based on the temperature and pressure of a refrigerant at the outlet of the evaporator 157 which are sensed by the temperature sensor 159A and the pressure sensor 159B. The controller 171 estimates a heat load based on the outputs of the in-car temperature sensor 161, the solar radiation sensor 162 and the outside air temperature sensor 163 and adjusts the degree of opening of the expansion valve 156 based on the estimated heat load and the outputs of the temperature sensor 159A and the pressure sensor 159B.

For example, when the controller 171 estimates based on the outputs of the in-car temperature sensor 161, the solar radiation sensor 162 and the outside air temperature sensor 163 that a heat load is high, the controller 171 rather increases the degree of opening of the expansion valve 156 so as to make the degree of superheat (state E indicated by the solid line in FIG. 5) at the outlet of the evaporator 157 as small as possible.

Figure 5:
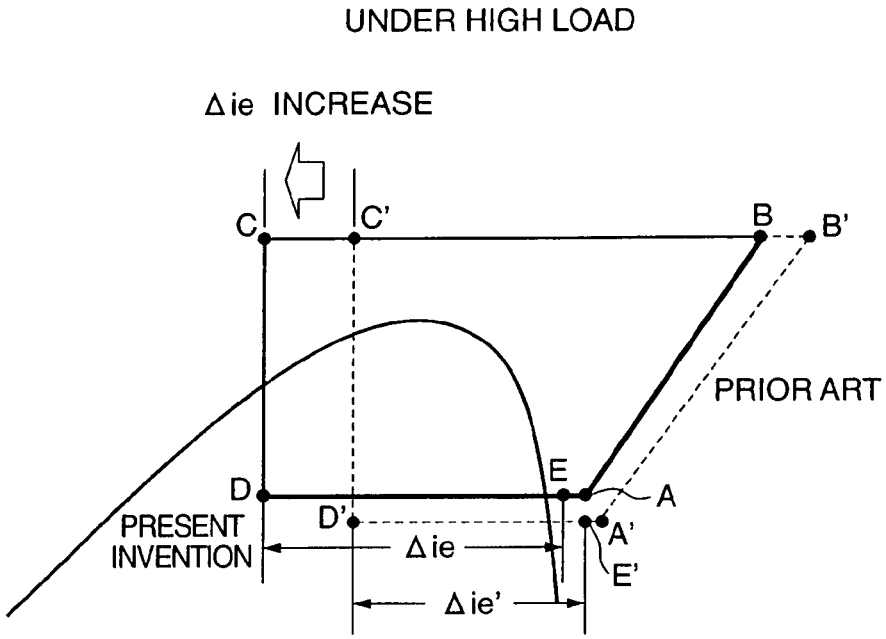
FIG. 5 is a p-h diagram of the refrigerant cycle of FIG. 2 under a high load for illustrating another present invention.

When the degree of superheat of the evaporator 157 is rendered large as shown by E' indicated by the broken line in FIG. 5 by making the degree of opening of the expansion valve 156 rather closed under the high load, a refrigerant in the evaporator 157 shifts from a state of a mixture of two phases, i.e., gas and a liquid, to a gaseous state nearly completely. Therefore, a refrigerant of lower pressure hardly evaporates in the intermediate heat exchanger 160, and the temperature of the refrigerant of lower pressure also increases. As a result, a refrigerant of higher pressure cannot be cooled to a sufficient degree. Particularly, the temperature of the refrigerant of lower pressure is more liable to increase when the temperature of outside air is high, so that heat exchange cannot be performed satisfactorily since a difference in temperature between the refrigerant of higher pressure and the refrigerant of lower pressure becomes small.

Meanwhile, when the degree of superheat is decreased, a refrigerant in the evaporator 157 does not shift from a state of a mixture of two phases, i.e., gas and a liquid, to a gaseous state completely. Then, the liquid refrigerant evaporates in the intermediate heat exchanger 160, thereby cooling a refrigerant of higher pressure. Consequently, the temperature of a refrigerant of lower pressure hardly increases in the intermediate heat exchanger 160 and is kept low, so that the refrigerant of higher pressure can be cooled sufficiently.

As a result, when the degree of superheat is decreased, the discharge temperature of refrigerant compressed in the compressor can be reduced (state B indicated by the solid line in FIG. 5). Thereby, the temperature of refrigerant at the inlet of the expansion valve 156 becomes low, and a difference in enthalpy in the evaporator 157 becomes large.

This condition will be described with reference to FIG. 5. That is, when the degree of superheat at the outlet of the evaporator 157 is increased under a high load, a refrigerant discharged from the compressor 10 becomes a state B' indicated by the broken line in FIG. 5 and a refrigerant passing through the expansion valve 156 and flowing into the evaporator 157 becomes a state D' indicated by the broken line in FIG. 5. The cooling capacity Qe' of the evaporator 157 in this case is expressed as Qe'=Δie'×Gr' (Δie' is a difference in enthalpy between E' and D', and Gr' is the flow rate of refrigerant).

Meanwhile, when the degree of superheat is decreased as described above, a cooling capacity Qe is expressed as Qe =Δie×Gr (Δie is a difference in enthalpy between E and D, and Gr is the flow rate of refrigerant). It is understood from this drawing as well that because Δie indicated by the solid line becomes larger than Δie' indicated by the broken line, the cooling capacity Qe also becomes larger than Qe' when the degree of superheat is increased, and the cooling capacity in the evaporator 157 improves.

Meanwhile, when the controller 171 estimates based on the outputs of the in-car temperature sensor 161, the solar radiation sensor 162 and the outside air temperature sensor 163 that a heat load is low (including medium and low loads), the controller 171 rather reduces the degree of opening of the valve so that the degree of superheat (state A indicated by the solid line in FIG. 6) at the outlet of the evaporator 157 becomes as large a value as about 5 deg.

Figure 6:
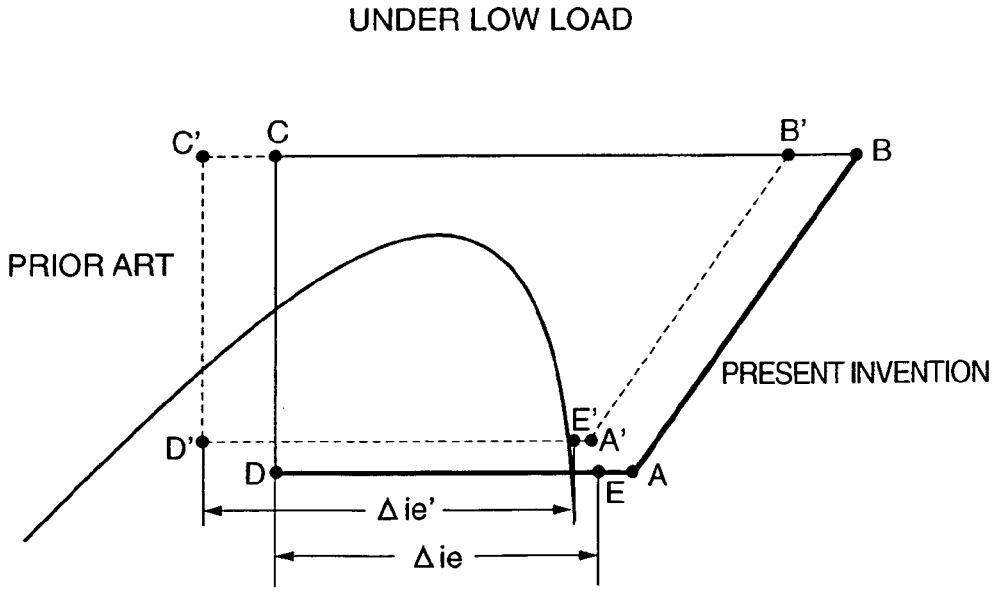
FIG. 6 is a p-h diagram of the refrigerant cycle of FIG. 2 under a low load for illustrating another present invention.

When the degree of superheat of the evaporator 157 is rendered small as shown by E' indicated by the broken line in FIG. 6 as a result of rendering the expansion valve 156 rather opened under a low load (including under a medium load; the same applies to the following description), the temperature of the refrigerant in the evaporator 157 becomes high, so that it cannot exchange heat with air to a sufficient extent, and the cooling capacity deteriorates.

Figure 7:
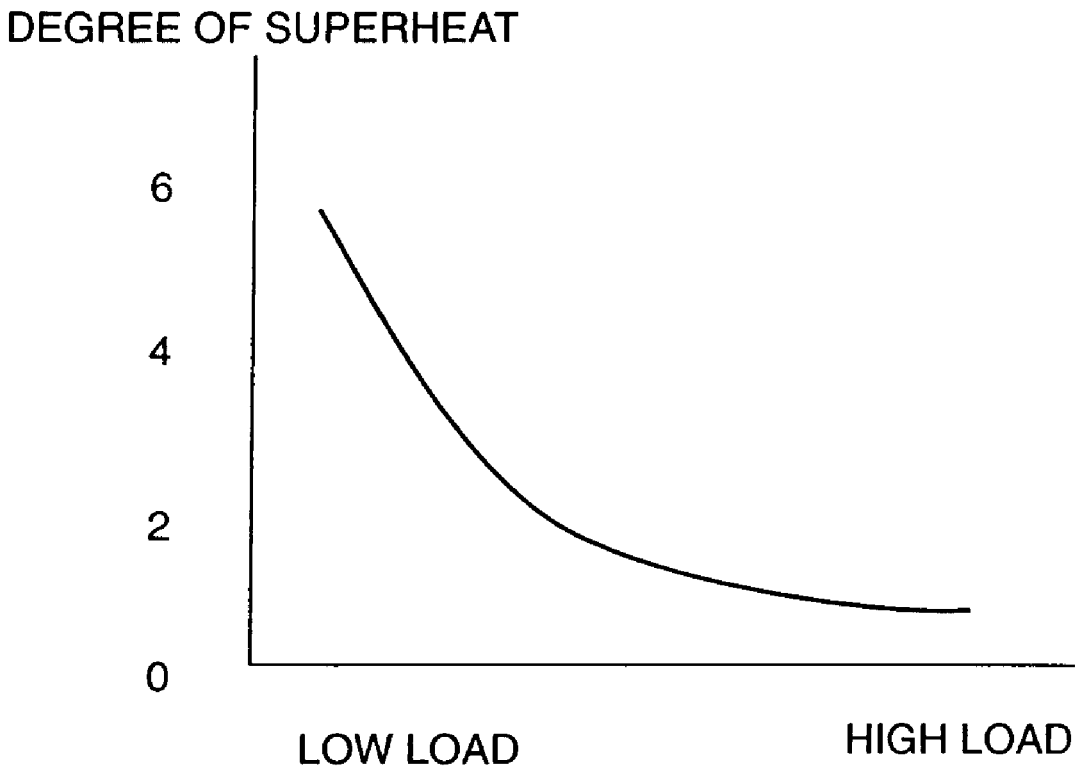
FIG. 7 is a diagram showing the relationship between heat load conditions for controlling the degree of superheat and the degree of superheat in another present invention.

The above control of the degree of superheat is shown in FIG. 7. That is, when the heat load estimated based on the outputs of the in-car temperature sensor 161, the solar radiation sensor 162 and the outside air temperature sensor 163 is a low load, the controller 171 rather reduces the degree of opening of the expansion valve 156 so as to make the degree of superheat large, while when the heat load is high, the controller 171 rather increases the degree of opening of the expansion valve 156 so as to make the degree of superheat small.

As described above, when the degree of opening of the expansion valve 156 is controlled so as to make the degree of superheat at the outlet of the evaporator 157 small when a heat load is estimated to be high based on the outputs of the in-car temperature sensor 161, the solar radiation sensor 162 and the outside air temperature sensor 163 and to make the degree of superheat at the outlet of the evaporator 157 large when the heat load is estimated to be low based on the outputs of the in-car temperature sensor 161, the solar radiation sensor 162 and the outside air temperature sensor 163, a difference in enthalpy in a refrigerant in the evaporator 157 becomes large, and an optimum cooling capacity in the evaporator 157 can be attained.

Thereby, under any heat load conditions, the cooling capacity of the evaporator 157 can be kept in an optimum condition.

Further, in this case as well, a refrigerant coming out of the evaporator 157 and passing through the intermediate heat exchanger 160 is allowed to flow into the receiver tank 158. Therefore, a low temperature refrigerant coming out of the evaporator 158 is allowed to flow into the intermediate heat exchanger without passing through the receiver tank 158 so as to cool a refrigerant coming out of the gas cooler more effectively. Thereby, a further improvement in the cooling capacity can be made.

Further, in the present embodiment, a heat load is estimated based on a combination of the outputs of the in-car temperature sensor 161, the solar radiation sensor 162 and the outside air temperature sensor 163. The present invention is not limited to such an embodiment, and the present invention is also effective in an embodiment in which a heat load is estimated based on the output of each of the in-car temperature sensor, the solar radiation sensor or the outside air temperature sensor.

As described in detail above, according to the present invention, in a refrigerant cycle system in which a compressor, a gas cooler, throttle means and an evaporator are sequentially connected in a cyclic form and a high pressure side is operated at a supercritical pressure, the degree of opening of the throttle means is adjusted based on heat load conditions so as to control the degree of superheat at the outlet of the evaporator. Thus, for example, by making the degree of superheat at the outlet of the evaporator small when a heat load is high and making the degree of superheat at the outlet of the evaporator large when the heat load is low, a difference in enthalpy of a refrigerant in the evaporator becomes large, so that an optimum cooling capacity in the evaporator can be attained.

Thereby, the refrigerating capacity of the evaporator can be retained in an optimum condition all the time even if heat load conditions are changed.

Particularly, since it becomes possible to enhance the refrigerating capacity without increasing the amount of circulating refrigerant under a high heat load, an improvement in the coefficient of performance of the compressor can be achieved.

Further, in this case as well, the system comprises a receiver tank for temporarily reserving a refrigerant to be sucked into the compressor and causes a refrigerant coming out of the evaporator and passing through the intermediate heat exchanger to flow into the receiver tank. As a result, a low temperature refrigerant coming out of the evaporator is allowed to flow into the intermediate heat exchanger without passing through the receiver tank so as to cool a refrigerant coming out of the gas cooler more effectively. Thereby, a further improvement in the cooling capacity of the evaporator can be achieved.

Further, in this case as well, in addition to the above inventions, a $CO_2$ refrigerant is used. This can contribute to the elimination of environmental issues.

What is claimed is:

1. A supercritical refrigerant cycle automobile air conditioning system comprising an internal intermediate pressure compressor, a gas cooler, an intermediate heat exchanger, throttle means and an evaporator sequentially connected in a cyclic form and a high pressure side is operated at a supercritical pressure, wherein:

the degree of opening of the throttle means is adjusted based on the temperature and pressure of a refrigerant at an outlet of the evaporator so as to control the degree of superheat at the outlet of the evaporator, said degree of superheat becomes as large a value as about 5 deg, and a controller controls the number of revolutions of the internal intermediate pressure compressor based on the output of an in-automobile temperature sensor or a solar radiation sensor or an outside air temperature sensor.

2. The system of claim 1, wherein the degree of superheat at the outlet of the evaporator is increased by the throttle means.

3. A supercritical refrigerant cycle automobile air conditioning system comprising an internal intermediate pressure compressor, a gas cooler, an intermediate heat exchanger, throttle means and an evaporator sequentially connected in a cyclic form and a high pressure side is operated at a supercritical pressure, wherein:

the degree of opening of the throttle means is adjusted based on heat load conditions so as to control the degree of superheat at an outlet of the evaporator, and a controller controls the number of revolutions of the internal intermediate pressure compressor based on the output of an in-automobile temperature sensor or a solar radiation sensor or an outside air temperature sensor.

4. The system of claim 3, wherein the degree of superheat at the outlet of the evaporator is decreased when a heat load is high and increased when the heat load is low.

5. The system as in any of claims 1, 2, 3 or 4, wherein the intermediate heat exchanger allows a refrigerant that has come out of the gas cooler to exchange heat with a refrigerant that has come out of the evaporator and a receiver tank for temporarily reserving a refrigerant to be sucked into the internal intermediate pressure compressor and causes a refrigerant which has come out of the evaporator and passed through the intermediate heat exchanger to flow into the receiver tank.

6. The system as in any of claims 1, 2, 3 or 4, wherein a $CO_2$ refrigerant is used.

* * * * *